United States Patent [19]

Ishii et al.

[11] Patent Number: 4,671,825

[45] Date of Patent: Jun. 9, 1987

[54] METHOD FOR FORMATION OF HYDROPHILIC CORROSION-RESISTANT COATING ON THE SURFACE OF METALLIC MATERIAL

[75] Inventors: Toru Ishii; Masashi Isobe; Mariko Endo, all of Kanbara, Japan

[73] Assignee: Nippon Light Metal Company Limited, Tokyo, Japan

[21] Appl. No.: 877,761

[22] Filed: Jun. 24, 1986

[30] Foreign Application Priority Data

Jun. 26, 1985 [JP] Japan ..... 60-137996

[51] Int. Cl.[4] ..... C23F 7/10; B05D 3/02

[52] U.S. Cl. ..... 148/6.15 R; 427/388.1; 427/388.2

[58] Field of Search ..... 148/6.15 R; 427/388.1, 427/388.2

[56] References Cited

U.S. PATENT DOCUMENTS 4,341,558 7/1982 Yashiro et al. ..... 106/14.12
4,349,391 9/1982 Schell ..... 148/6.15 R
4,427,459 1/1984 Goltz ..... 148/6.15 R
4,462,842 7/1984 Uchiyama et al. ..... 148/6.15 R
4,524,092 6/1985 Cesca et al. ..... 427/388.2
4,595,424 6/1986 Hacias ..... 148/6.15 R

*Primary Examiner*—Thurman K. Page
*Attorney, Agent, or Firm*—William J. Daniel

[57] ABSTRACT

A hydrophilic corrosion-resistant coat is formed on the surface of a metallic material, e.g., aluminum and its alloys, by a method which comprises preparatorily cleaning the surface of the metallic material, applying on the cleaned surface of the metallic material an aqueous treating liquid produced by adding a water-soluble acrylic acid polymer and colloidal silica and effective amounts of a polyhydric alcohol and/or saccharide to an aqueous solution containing hexavalent chromium compound or trivalent and hexavalent chromium compounds, phosphoric acid, and a fluorine compound. The applied layer of the treating liquids is dried and baked, the baking being at a temperature in the range of 100° to 250° C.

22 Claims, No Drawings

METHOD FOR FORMATION OF HYDROPHILIC CORROSION-RESISTANT COATING ON THE SURFACE OF METALLIC MATERIAL

BACKGROUND OF THE INVENTION

1. Field of the Invention

This invention relates to a method for the formation of a hydrophilic corrosion-resistant coating on the surface of a metallic material, particularly a material of aluminum or aluminum alloy (hereinafter referred to collective as "aluminum").

2. Description of the Prior Art

Metallic materials, particularly aluminum material, excel in thermal conductivity and, therefore, have long been used extensively in making fins for heat exchangers in air conditioners. When the metallic materials are used in heat exchangers, the properties they are required to possess are freedom from corrosion under wet conditions and sufficient surface hydrophilicity to be readily wet with water.

Heretofore, in the use of aluminum for fins in heat exchangers, it has been often customary for the aluminum material to be chemically treated by the so-called chromate method, which comprises immersing the aluminum material in an aqueous solution of a chromate, or by the so-called phosphoric acid chromate method, which comprises immersing the aluminum material in the aqueous solution containing a chromate, a phosphate, and a fluoride thereby forming a corrosion-resistant protective coating on the surface of the aluminum material before the aluminum material is exposed to a corrosive environment. Although the coating obtained by the conventional chemical treatment is relatively high in corrosion-resistance, its surface is deficient in hydrophilicity. When this material is used for cooling fins, for example, the fins cause poor cooling efficiency because the water from the ambient air which condenses on the surface of the coating does not uniformly wet that surface but collects as spherical drops. Further, these condensed droplets on the surface of fins often form what is called a bridge between fins and, as the result, offers increased resistance to the current of air flowing through the air conditioner and causes noise and increased energy consumption.

In order to confer hydrophilicity upon the corrosion-resistant coating formed chemically on the surface of a metallic material. U.S. Pat. No. 4,462,842 discloses a method which comprises immersing an aluminum material on which a chromate or chromate-phosphate coating has been formed in a bath containing colloidal silica or silicate, thereby depositing on the coating a hydrophilic colloidal silica or silicate layer which imparts hydrophilicity to the coating. The hydrophilic colloidal silica or silicate layer thus formed on the surface of the chromate or chromate-phosphate coating has insufficient binding force or adherence for the chromate or chromate-phosphate undercoating and, therefore, has the disadvantage that it will readily peel off the surface of the coating while in use and is not durable.

In view of this state of affairs and with a view to forming a more durable hydrophilic coating on the surface of a metallic material, the inventors previously proposed a method for the formation of a coating (Japanese Patent Application Laid-open No. SHO 60(1985)-39,169) which comprises coating the surface of a metallic material with a treating liquid prepared by adding a water-soluble acrylic acid polymer and colloidal silica to an aqueous solution containing trivalent and hexavalent chromium compounds and a fluorine compound, drying the coated metallic material, and subjecting the dried coated metallic material to a baking treatment. In accordance with this method, a durable hydrophilic coating can be formed because the phosphoric chromate type undercoat formed primarily on the surface of the metallic material is covered with an acrylic resin coating vested with hydrophilicity owing to the uniform dispersion and inclusion therein of colloidal silica. Nevertheless, it has been found that even by this method, the following problem remains yet to be solved.

The coating which is obtained by the method of Japanese Patent Application Laid-open No. SHO 60(1985)-39,169 is of the so-called non-rinse type which is obtained by applying a film-forming treating liquid on the surface of the metallic material and, without rinsing the coated surface, subjecting the coated metallic material to drying and baking. In the acrylic resin coating to which hydrophilicity is imparted by the addition of colloidal silica in accordance with this method, therefore, the amount of the residue of water-soluble hexavalent chromium compound from the treating liquid is so large as to be harmful to humans. When the metallic material treated by this method is used for the cooling fins of an air conditioner, for example, the possibility exists that the hexavalent chromium salt from the coating may dissolve into the water condensed from the ambient air and creates a pollution problem. Moreover, while the coating obtained by this method endures much longer in use than the hydrophilic coating having colloidal silica simply deposited on a chemical undercoat, because the colloidal silica is dispersed and retained fast within the layer of acrylic acid resin, this coating nevertheless is slightly inferior in the degree of initial hydrophilicity.

SUMMARY OF THE INVENTION

The inventors have continued their research with a view to solving the problems encountered by the method of Japanese Patent Application Laid-open No. SHO 60(1985)-39,169 as described above. They have consequently found that by treating a metallic material with a liquid produced by adding a small amount of a polyhydric alcohol or saccharide to a non-rinse type treating liquid prepared by the addition of a water-soluble acrylic acid polymer and colloidal silica to an aqueous solution containing trivalent and hexavalent chromium compounds, phosphoric acid, and a fluorine compound, the dissolution of harmful hexavalent chromium salt from the applied coat can be repressed and a corrosion-resistant coating of further improved hydrophilicity can be achieved.

DETAILED DESCRIPTION OF THE INVENTION

To be specific, this invention concerns a method for forming a hydrophilic corrosion-resistant coating on the surface of a metallic material, which method comprises preparatorily cleaning the surface of the metallic material, applying on the cleaned surface an aqueous treating liquid produced by adding a water-soluble acrylic acid polymer and colloidal silica and selected amounts of polyhydric alcohols and/or saccharides to an aqueous solution containing hexavalent chromium compound or trivalent and hexavalent chromium compounds, phosphoric acid, and a fluorine compound, drying the applied layer of the treating liquid, and then drying and baking the applied layer at a baking temperature in the range of 100° to 250° C.

These and other objects and characteristics of this invention will become apparent from the following detailed description of a preferred embodiment of the method of the invention.

Although the method of this invention is applicable to such metallic materials as steel material, zinc material, and galvanized iron material, it manifests an outstanding effect when it is applied to aluminum material.

The metallic material as a substrate should have the surface thereof cleaned in advance by the conventional method using an organic solvent or an acid or alkali solution for removal of foreign matter adhering thereto.

By the method of the present invention, the treating liquid produced by adding a water-soluble acryl acid polymer, colloidal silica and polyhydric alcohols or saccharides to an aqueous solution containing hexavalent chromium compound or trivalent and hexavalent chromium compounds, phosphoric acid, and a fluorine compound is applied to the cleaned surface and dried. The treating liquid thus used can be prepared as follows.

As a trivalent chromium compound, chromium sulfate, chromium nitrate, or chromium acetate can be used. As a hexavalent chromium compound, chromic acid ($CrO_3$), or a chromate or bichromate such as ammonium chromate or ammonium bichromate can be used. The treating liquid may further be prepared by adding a desired amount of a strong reducing agent such as formalin in stead of the trivalent chromium compound to the aqueous solution so as to reduce a part of the hexavalent chromium compound into the trivalent chromium compound.

As the phosphoric acid, orthophosphoric acid, pyrophosphoric acid, polyphosphoric acid, metaphosphoric acid, or phosphorous acid can invariably by used advantageously. Use of such phosphoric acid in the form of an alkali salt such as sodium phosphate or sodium pyrophosphate is desired to be avoided because the alkali salt of phosphoric acid possibly has adverse effects on the corrosiveness of the coating.

The fluorine compound should be a water-soluble compound such as hydrofluoric acid, silicon fluoride, boron fluoride, titanium fluoride, zirconium fluoride, or zinc fluoride. Hydrofluoric acid is preferred. The addition of the fluoride, coupled with the presence of a chromium compound, has an effect of forming a compact and strong corrosion-resistant coating on the surface of the metallic material and giving a slight degree of dissolving action to the silica dispersed in the acrylic resin film and contributing to enhancing the hydrophilicity of the film.

As an acrylic acid polymer, the polymer or copolymer of acrylic acid or an acrylic ester such as methyl acrylate, ethyl acrylate, isopropyl acrylate, or n-butyl acrylate, methacrylic acid or a methacrylic ester such as methyl methacrylate, ethyl methacrylate, isopropyl methacrylate, or butyl methacrylate which has an average molecular weight in the range of 10,000 to 300,000 and which is soluble in water can be used. As a specific example of such acrylic acid resin, a product of Rohm and Haas Co., marketed under trademark designation of "Acrysol" can be cited.

The colloidal silica which is incorporated in the treating liquid may be in the form of either powder or sol. For example, either fumed silica or amorphous hydrated silicic acid produced by the wet method can be used. Since the colloidal silica needs to be uniformly dispersed in the acrylic acid resin film and confer desirable hydrophilicity upon the film, it should have an average particle diameter of not more than 1 μm. Commercial products satisfying this requirement include CAB-O-SIL (product of Cabot Co.) and CARPLEX (product of Shionogi & Co. Ltd.), for example.

The treating liquid used for the coating by this invention incorporates an effective amount of a polyhydric alcohol or saccharide in addition to the components mentioned above. This polyhydric alcohol or saccharide does not reduce the hexavalent chromium compound in the treating liquid at normal room temperature. In the final step of the formation of the coating, drying and baking with a baking temperature of not more than 250° C., the polyhydric alcohol or saccharide converts the harmful hexavalent chromium compound contained in the acrylic acid resin layer into a harmless trivalent chromium compound and represses the dissolution of the chromium compound out of the applied coating. As the alcohol, a divalent or trivalent alcohol as ethylene glycol or glycerine can be used. As the saccharide, a monosaccharide or disaccharide such as grape sugar, fruit sugar, or cane sugar can be used.

The desirable proportions in which the aforementioned components are to be incorporated in the treating liquid of this invention are as follows.

The concentration of chromium compounds (total chromium concentration = trivalent chromium + hexavalent chromium) as $CrO_3$ is in the range of 2 to 20 g/lit., preferably 3 to 12 g/lit., including hexavalent chromium compound as $CrO_3$ in an amount of not less than 1 g/lit.

Phosphoric acid is incorporated as $PO_4^{-3}$ in the range of 0.1 to 20 g/lit., preferably 0.3 to 8 g/lit. The addition of phosphoric acid is effective in forming a corresion-resistant chromate-phosphate type coating on the surface of the metallic material and allowing the hydrophilicity of the superposed acrylic acid resin layer to be retained intact for a long time. If the amount of phosphoric acid added is less than the lower limit of the range mentioned above, the effect of the added phosphoric acid in retaining the hydrophilicity is not manifested sufficiently.

The concentration of fluorine compounds as $F^{-1}$ is in the range of 0.1 to 5 g/lit., preferably 0.3 to 3.5 g/lit.

The amount of the acrylic acid polymer to be added to the mixed aqueous solution to which chromium, phosphoric acid, and fluorine compounds have been added as described above generally falls as solids in the range of 2 to 20 g/lit. This amount is desired to be suitably increased or decreased in accordance with the amounts of the other components contained in the treating liquid.

The amount of colloidal silica to be incorporated in the treating liquid is dependent upon the content of solids in the film-forming ingredients. The silica is incorporated in an amount such that the weight ratio of silica to the total of nonvolatile components including silica (hereinafter referred to as "silica ratio") will fall in the range of 0.2 to 0.8, preferably 0.3 to 0.6. If the silica ratio is less than 0.2, a coating of lasting hydrophilicity cannot be obtained easily. If the silica ratio exceeds 0.8, there ensues the disadvantage that the coat will assume a dusty surface.

The polhydric alcohol or saccharide, during the baking of the applied treating liquid, promotes the conversion of the hexavalent chromium remaining in the coating into trivalent chromium, and will also persists in the coat after formation of the coat, acting to reduce to trivalent form any hexavalent chromium tending to dissolve out of the coat and thereby preclude the escape of hexavalent chromium ion. The addition of the polyhydric alcohol or saccharide, coupled with the addition of colloidal silica, further enhances the hydrophilicity of the acrylic acid film. If the amount of the polyhydric alcohol or saccharide to be added is too large, the degree of adhesion of the acrylic acid resin film to the substrate is lowered. This amount is desired to be selected in the range of 0.3 to 20 g/lit., preferably 0.5 to 10 g/lit., in due consideration of the concentration of the hexavalent chromium ion and of the acrylic acid polymer in the treating liquid.

The components of the treatment solution of the invention tend to undergo reaction when a solution containing same in dissolved form is kept for considerable periods of time, say, in excess of 2–3 weeks. For example, the hexavalent chromium ions are reduced to trivalent chromium by the chemical reducing action of the polyhydric compound which reduction occurs gradually with time, resulting in the formation of a precipitate. Consequently, it is preferred that the final treating solution be prepared substantially at the time of application or at the least not more than about 2–3 weeks prior to its actual utilization. However, it may be more convenient to prepare in advance stock solutions which contain selected combinations of constituents which do not undergo reaction and hence can be stored for long periods of time and then mixed together to form the ultimate treating solution itself at the time of utilization. For example, one such stock solution could contain the acrylic acid polymer, the dispersed colloidal silica and polyhydric compound, while the other might contain the chromium compounds, phosphoric acid and the fluorine compound.

Then, the treating liquid prepared as described above is applied on the previously cleaned surface of the metallic material. The dry weight of the treating liquid applied on the metallic material as in the range of about 0.1 to 5 g/m$^2$, preferably 0.5 to 3 g/m$^2$. The thickness of the eventual coating can be adjusted by adjusting the concentration of the treating liquid. As the method of application, rolling or spraying can be adopted in the case of metallic materials of such a simple shape as continuous plates or extruded plates. Brushing, immersion, or spraying are more suitable for complex shapes. By allowing the metallic material on which the treating liquid has been applied to stand undisturbed for several seconds to several minutes, the chromium compound, phosphoric acid, and fluorine compound contained in the treating liquid act on the metallic material and form a compact chromate-phosphate type corrosion-resistant chemical coating on the surface of the metallic material.

Then, the applied liquid adhering to the surface of the metallic material, without being rinsed or washed, is dried and heated to a baking temperature. This baking treatment has dual significance, i.e., in converting the water-soluble acrylic acid polymer in the coating into an insoluble acrylic resin film or layer and in converting the harmful hexavalent chromium salt remaining in the film into a harmless trivalent chromium salt. More specifically, during baking, the water-soluble acrylic acid polymer in the film is cross-linked by reaction with the chromium compound remaining in the film to form an insoluble acrylic resin film and, at the same time, the greater part of the hexavalent chromium compound remaining in the film is converted into a harmless trivalent chromium compound by the chemical reducing action of the polyhydric alcohol or saccharide incorporated in the treating liquld.

The duration of the baking treatment mentioned above is a few seconds to some tens of minutes at a temperature in the range of 100° to 250° C. If the temperature of this treatment is less than 100° C., very little of the hexavalent chromium salt is converted to the trivalent chromium salt. If the temperature exceeds 250° C., the resin component may be decomposed and degraded. Thus, any deviation of the temperature from the aforementioned range should be avoided. By the baking treatment, the exterior surface of the corrosion-resistant chemical coating formed on the surface of the metallic material is formed by a cross-linked acrylic acid resin.

The acrylic acid resin coat obtained as described above has colloidal silica uniformly dispersed therein. Owing to the uniform dispersion of colloidal silica, coupled with the action of the polyhydric alcohol or saccharide contained in the coat, the surface of this acrylic acid resin coat exhibits highly satisfactory hydrophilicity.

EXAMPLES

Now, this invention will be described more specifically below with reference to working examples.

Examples 1–9:

(1) Preparation of treating liquid

With its components present in varying percentages as indicated in the separate Table I, an aqueous treating solution (Solution A) was prepared by using chromium sulfate, $Cr_2(SO_4)_3.5H_2O$, as a trivalent chromium compound, chromium trioxide as a hexavalent chromium compound, hydrofluoric acid (46% HF) as a fluorine compound, and orthophosphoric acid as phosphoric acid and a separate liquid (Liquid B) was prepared by uniformly dispersing silica powder having an average particle diameter of 0.01 μm (product of Cabot Co. and marketed under the trademark designation "CAB-O-SIL") in an aqueous 25 wt% solution containing polyacrylic acid (product having a molecular weight of not more than about 50,000 of Rohm and Haas Co. and marketed under trademark designation of "Acrysol") and further adding thereto a polyhydric alcohol and/or saccharide of reagent purity.

(2) Formation of coating

An aluminum material (AA3102; 0.15 mm in thickness × 10 mm × 100 mm) was subjected to a conventional degreasing pretreatment. The actual treating agent was prepared by mixing Solution A and Liquid B produced as described above in (1) and was immediately applied on the surface of the aluminum material at a rate of 40 ml/m$^2$ by roller coating. Then, in a hot air oven, the applied coat was baked at 130° C. for 10 minutes to be rendered infusible.

(3) Evaluation test (a) Hydrophilicity test:

(A) Initial hydrophilicity (before treatment): A sample of the aluminum material was immersed in deionized water at room temperature for one minute, then removed and left standing at room temperature for about 30 seconds, and examined by the water-immersion method which rates the hydrophilicity by the percentage of surface area wetted with water.

(B) Persistent hydrophilicity (72 hours): A sample was left standing for 72 hours under the conditions of the cooling-heating cycle method (repetitions of a cycle consisting of $-10°$ C.$\times$1 hr$\rightarrow-10°$ C.$\sim$70° C.$\times$1 hr$\rightarrow$70° C.$\times$1 hr$\rightarrow$70° C.$\sim-10°$ C.$\times$1 hr). It was then subjected to the water-immersion method which determines the hydrophilicity by the percentage of surface area wetted with water.

(b) Corrosion-resistance test:

A material sample was sprayed with salt water by the method specified in JIS Z-2371(1955) and the ratios of surface area showing corrosion consequently after 240 hours' and 500 hours' standing were measured.

(c) Dissolution of hexavalent chromium ion test:

A material sample was kept immersed in deionized water at 35° C. for one week and the deionized water was analyzed for hexavalent chromium ion dissolved out of the sample.

(4) Evaluation

The results obtained in the tests mentioned above are shown in Table I. Although the treating liquids of this invention used hexavalent chromium at higher concentrations than conventional treating liquids, they did not lose hexavalent chromium ions into solution and they showed hydrophilicity and corrosion-resistance both on satisfactory levels.

Comparative Experiments 1–4:

Treating liquids varying in composition as indicated at the bottom of Table I were prepared by following the procedure of Examples 1–9. They were similarly applied as a coating on the surface of an aluminum material. The coating so formed was subjected to the various similar tests.

The results obtained are shown in Table I. In Comparative Experiment 1, in spite of an ample silica ratio, the persistent hydrophilicity was inferior because of the omission of the phosphoric acid while dissolution of hexavalent chromium ions from the applied coating was observed because of the absence of either a polyhydric alcohol or saccharide.

In Comparative Experiment 2, while the corrosion-resistance was satisfactory, dissolution of hexavalent chromium ions from the applied coating was observed and the persistent hydrophilicity was insufficient because of the absence of either a polyhydric alcohol or saccharide.

In Comparative Experiment 3, the persistent hydrophilicity and the corrosion-resistance were insufficient because of insufficient silica. Dissolution of hexavalent chromium ions from the applied coating was observed because of the absence of either a polyhydric alcohol or saccharide.

In Comparative Experiment 4, the coating was deficient in corrosion-resistance because of an insufficient total chromium concentration. Dissolution of hexavalent chromium ion from the applied coating was observed because of the absence of either a polyhydric alcohol or saccharide.

TABLE I

| | Chromium conc. as $CrO_3$ (g/l) | | | Acrylic acid polymer (solids) g/l | Silica | | $F^-$ g/l | $PO_4^{-3}$ g/l | pH of liquid | Reducing agent, g/l |
|---|---|---|---|---|---|---|---|---|---|---|
| | Tri-valent | Hexa-valent | Total | | g/l | Silica ratio | | | | |
| Example | | | | | | | | | | |
| 1 | | 3 | 3 | 6 | 15 | 0.49 | 1 | 5 | 1.7 | Glycerin 0.5 |
| 2 | 0.5 | 10 | 10.5 | " | " | 0.35 | " | " | 2.2 | Glycerin 5 |
| 3 | 0.5 | 3 | 3.5 | " | " | 0.42 | " | " | 1.8 | Grape sugar 5 |
| 4 | — | 5 | 5 | " | " | 0.36 | " | " | 1.9 | Grape sugar 10 |
| 5 | 3 | 3 | 6 | " | " | 0.44 | " | " | 1.75 | Fruit sugar 1 |
| 6 | — | 3 | 3 | " | " | 0.48 | " | " | 1.7 | Glycol 1 |
| 7 | 7 | 3 | 10 | 10 | 28 | 0.49 | " | 7 | 1.6 | Glycerin 0.7 |
| 8 | 10 | 2 | 12 | " | 30 | " | 2 | " | " | Glycerin 0.7 |
| 9 | 2 | 4 | 6 | 8 | 12 | 0.35 | 1 | 5 | 1.8 | Glycerin 1 + grape sugar 1 |
| Comparative Experiment | | | | | | | | | | |
| 1 | 10 | 0.5 | 10.5 | 10 | 12 | 0.35 | 2 | 0 | 1.6 | — |
| 2 | — | 3 | 3 | 6 | 15 | 0.5 | 1 | 5 | 1.7 | — |
| 3 | — | 10 | 10 | " | " | 0.17 | " | " | 2.9 | — |
| 4 | 0.5 | 1 | 1.5 | " | " | 0.51 | " | " | 2.7 | — |

| | Hydrophilicity | | Corrosion (Salt water spray test) | | Dissolution of hexavalent chromium ion from applied coat |
|---|---|---|---|---|---|
| | Initial | After 72 hours | After 240 hours | After 500 hours | |
| Example | | | | | |
| 1 | 100% | 100% | 0% | 0% | No |
| 2 | " | " | " | " | " |
| 3 | " | " | " | " | " |
| 4 | " | " | " | " | " |
| 5 | " | " | " | " | " |
| 6 | " | " | " | " | " |
| 7 | " | " | " | " | " |
| 8 | " | " | " | " | " |
| 9 | " | " | " | " | " |
| Comparative Experiment | | | | | |

TABLE I-continued

| | | | | | |
|---|---|---|---|---|---|
| 1 | 100 | 70 | 0 | 0 | Yes |
| 2 | " | 85 | " | " | " |
| 3 | " | 20 | " | 20 | " |
| 4 | " | 100 | 40 | 60 | " |

Obviously, many modifications and variations of the present invention are possible in light of the above teachings. It is, therefore, to be understood that within the scope of the appended claims, the present invention may be practiced otherwise than as specifically described herein.

SUMMARY OF THE INVENTION RESULTS

As described above, the method of this invention, by having an effective amount of a polyhydric alcohol or saccharide incorporated in an aqueous treating liquid obtained by adding a water-soluble acrylic acid polymer and colloidal silica to an aqueous solution containing trivalent and hexavalent chromium compounds, phosphoric acid, and a fluorine compound, and thereby utilizing the capability of the polyhydric alcohol or saccharide to reduce harmful hexavalent chromium ions present in the coating into harmless trivalent chromium ions when exposed to an elevated temperature during the final step of the process when acrylic acid resin is baked, and consequently precluding dissolution of hexavalent chromium ions out of the coating by condensed moisture in contact therewith. The acrylic resin coating thus obtained has colloidal silica uniformly dispersed therein, which coupled with the activity of the residual polyhydric alcohol or saccharide imparts to the surface of the coating a highly desirable hydrophilicity for a long time. The treated material is hence especially suited for the construction of cooling fins or the like in air conditioning units.

Even when the metallic material which is treated by the method of the present invention is used as cooling fins in an air conditioner, therefore, the coat on the fins does not dissolve out the harmful hexavalent chromium from the surface and enables the fins to manifest their outstanding cooling effect for a long time.

What is claimed is:

1. A method of forming a hydrophilic corrosion-resistant coating on a metallic surface comprising the steps of: applying on such surface an aqueous solution containing dissolved therein (a) a water-soluble acrylic acid polymer, (b) dispersed colloidal silica, (c) hexavalent chromium compound, (d) at least one water-soluble polyhydric compound, effective to reduce said hexavalent chromium to trivalent chromium, (e) phosphoric acid, and (f) a fluorine compound, and drying and baking the treated metallic material with the baking temperature being in the range of 100° to 250° C.

2. The method of claim 1 wherein said solution contains further trivalent chromium compound.

3. The method of claim 1 or 2 wherein said solution is prepared by mixing separate aqueous solutions containing the constituents (a), (b) and (d) and (c), (e) and (f), respectively.

4. The method of claim 1 wherein said polyhydric compound is a polyhydric alcohol or a saccharide.

5. A method according to claim 4, wherein said aqueous solution contains a total content of water-soluble chromium compounds as $CrO_3$ in the range of 2 to 20 g/lit., including not less than about 1 g/lit. hexavalent chromium, a phosphoric acid as $PO_4^{-3}$ in the range of 0.1 to 20 g/lit., a fluorine compound as $F^-$ in the range of 0.1 to 5 g/lit., a water-soluble acrylic acid polymer as solids in the range of 2 to 20 g/lit., colloidal silica at a weight ratio of silica/total nonvolatile components in the range of 0.2 to 0.8, and at least one member selected from the group consisting of the polyhydric alcohols and saccharides in the range of 0.3 to 20 g/lit.

6. A method according to claim 5, wherein said total chromium compounds are contained in an amount in the range of 3 to 12 g/lit.

7. A method according to claim 5, wherein said phosphoric acid is contained as $PO_4^{-3}$ in the range of 0.3 to 8 g/lit.

8. A method according to claim 5, wherein said fluorine compound is contained as $F^-$ in the range of 0.3 to 3.5 g/lit.

9. A method according to claim 5, wherein said colloidal silica is contained as weight ratio of silica/total nonvolatile components in the range of 0.3 to 0.6.

10. A method according to claim 5, wherein said at least one member is contained in an amount in the range of 0.5 to 10 g/lit.

11. A method according to claim 2, wherein said trivalent chromium compound is chromium sulfate, chromium nitrate, or chromium acetate.

12. A method according to claim 1, wherein said hexavalent chromium is chromic acid, ammonium chromate, ammonium chromate, or ammonium bichromate.

13. A method according to claim 1, wherein said phosphoric acid is orthophosphoric acid, pyrophosphoric acid, polyphosphoric acid, metaphosphoric acid, or phosphorous acid.

14. A method according to claim 1, wherein said fluorine compound is soluble in water and is hydrofluoric acid, silicon fluoride, boron fluoride, titanium fluoride, zirconium fluoride, or zinc fluoride.

15. A method according to claim 1, wherein said acrylic acid polymer is acrylic acid, methyl acrylate, ethyl acrylate, isopropyl acrylate, n-butyl acrylate, methyl methacrylate, ethyl methacrylate, isopropyl methacrylate, or butyl methacrylate.

16. A method according to claim 15, wherein said acrylic acid polymer has an average molecular weight in the range of 10,000 to 300,000 and is soluble in water.

17. A method according to claim 1, wherein said colloidal silica is in finely divided form with an average particle diameter of not more than 1 μm.

18. A method according to claim 16, wherein said colloidal silica is fumed silica or hydrated silicic acid.

19. A method according to claim 1, wherein said polyhydric alcohol is ethylene glycol or glycerine.

20. A method according to claim 1, wherein said saccharide is grape sugar, fruit sugar, or cane sugar.

21. A method according to claim 4, wherein said mixture is applied on the surface of said metallic material to give a layer having a dry weight in the range of 0.1 to 5 $g/m^2$.

22. A method according to claim 21, wherein the dry weight of said applied layer is in the range of 0.5 to 3 $g/m^2$.

* * * * *

UNITED STATES PATENT AND TRADEMARK OFFICE

CERTIFICATE OF CORRECTION

PATENT NO. : 4,671,825

DATED : June 9, 1987

INVENTOR(S) : Toru Ishii et al

It is certified that error appears in the above-identified patent and that said Letters Patent is hereby corrected as shown below:

In the Claims:

Claim 20, line 1 (column 10, line 58), "1" should read -- 4 --.

Claim 21, line 1 (column 10, line 60), "4" should read -- 1 --.

Signed and Sealed this

Eighth Day of September, 1987

*Attest:*

DONALD J. QUIGG

*Attesting Officer*

*Commissioner of Patents and Trademarks*